US008002034B2

(12) United States Patent
Sadok

(10) Patent No.: US 8,002,034 B2
(45) Date of Patent: Aug. 23, 2011

(54) RECOVERY OF HYDROCARBONS FROM OIL SHALE DEPOSITS

(75) Inventor: Richard D. Sadok, Bartlesville, OK (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 12/711,732

(22) Filed: Feb. 24, 2010

(65) Prior Publication Data

US 2010/0218945 A1 Sep. 2, 2010

Related U.S. Application Data

(60) Provisional application No. 61/156,266, filed on Feb. 27, 2009.

(51) Int. Cl.
*E21B 43/24* (2006.01)

(52) U.S. Cl. ..... 166/272.1; 166/272.7

(58) Field of Classification Search ..... 166/272.1, 166/272.7

See application file for complete search history.

(56) References Cited

U.S. PATENT DOCUMENTS 6,722,431 B2 * 4/2004 Karanikas et al. ..... 166/251.1
6,973,967 B2 * 12/2005 Stegemeier et al. ..... 166/245

* cited by examiner

*Primary Examiner* — William P Neuder

(57) ABSTRACT

This invention relates to recovering hydrocarbons from oil shale preferably in-situ where the temperature of the oil shale deposit is controlled to maximize recovery of hydrocarbons and minimize decomposition of carbonate minerals into carbon dioxide that might be released into the atmosphere. The process includes generating heat from hydrocarbon gases recovered from the oil shale and then later performing a controlled burn of the char that is left in the spent shale after the kerogens have been thermally cracked and the most of the recoverable hydrocarbons have been recovered. The burning of the char is also controlled based on the temperature of the oil shale in-situ, the temperature of the gases returning to the surface from the oil shale and the carbon dioxide in the gases returning to the surface.

12 Claims, 3 Drawing Sheets

RECOVERY OF HYDROCARBONS FROM OIL SHALE DEPOSITS

CROSS-REFERENCE TO RELATED APPLICATIONS

This application is a non-provisional application which claims benefit under 35 USC §119(e) to U.S. Provisional Application Ser. No. 61/156,266 filed Feb. 27, 2009, entitled "Recovery of Hydrocarbons From Oil Shale Deposits," which is incorporated herein in its entirety.

STATEMENT REGARDING FEDERALLY SPONSORED RESEARCH OR DEVELOPMENT

None

FIELD OF THE INVENTION

This invention relates to the recovery of hydrocarbons from in ground oil shale reserves.

BACKGROUND OF THE INVENTION

The United States has an almost unimaginable volume of hydrocarbons locked up in huge reserves of oil shale. However, the current technology for recovering oil from oil shale has been a substantially expensive process that is only economically viable when crude oil prices are high. Shale does not have the energy density of coal with more than about 85% being rock.

While mining the shale is discouraged by the cost, another technique for liberating the hydrocarbons has been to create an underground retort or reaction vessel and heating shale to a temperature that cracks the hydrocarbon and releases a shale oil. The process of creating the retort begins by defining the area that one wants to work with. Keep in mind that the shale deposits can extend horizontally for hundreds of miles. So, for instance, an in-situ retort may be defined as perhaps 200 feet by 400 feet and by the thickness of the oil shale deposit which can vary between 200 feet and up to 2,000 feet thick. Within the retort area, about twenty percent of the shale deposit is removed or mined out and the remaining portion has boreholes drilled in a pattern for an explosive to convert the solid shale formation into rubble. This rubbilizing process opens up the shale so that it can be heated by the circulation of hot gases and a drain is installed at the base of the retort to collect the shale oil. The heat of the process also creates gases including hydrocarbons which are collected through a separate recovery device.

Into the top of the retort, air is injected and a combustion process is ignited. The retort includes an overburden so the top of the retort is not open to the atmosphere. The air injection provides enough oxygen for combustion, but does not burn all of the hydrocarbons. Indeed, the remaining gases in the retort are oxygen depleted so the hydrocarbons are thermally cracked and vaporized. Some of this product condenses into hydrocarbon liquids when cooled in lower regions of the retort. It then drains by gravity to recovery equipment at the bottom of the retort. This process may burn for many months, but the temperature control is quite poor and the retort can easily reach very high temperatures up to and including 1,700° F. This process was developed before concerns were substantially raised about the liberation of carbon dioxide and other greenhouse gases. The rock which holds the kerogen is substantially comprised of metal carbonates such as calcium carbonate, aluminum carbonate. If these rock materials are heated in excess of 1,100 F, they decompose into metal oxides and carbon dioxide. Many tons of carbon dioxide could easily be released by processing of one retort of the size described and the carbon would not be from the small amount of hydrocarbon present.

Clearly, technology for economically recovering oil shale would be very helpful to the United States in terms of American energy independence, but recovery of the oil shale must be accomplished in an environmentally safe and sensitive manner for the technology to be practically applied.

SUMMARY OF THE INVENTION

The present invention more particularly comprises a process for recovering hydrocarbons from oil shale where the process comprises a first step of identifying a quantity of oil shale in the ground. A portion of the oil shale is removed to create void space in the oil shale formation in the ground and the remaining oil shale is rubblized to enable gases to flow through the identified quantity of oil shale. A gas delivery line is installed near an upper portion of the identified quantity of oil shale and gas and liquid recovery lines are installed near the lower portion of the identified quantity of oil shale. A substantially oxygen-free gas is injected through the gas delivery line that is heated to a temperature that will increase the temperature of the identified quantity of oil shale and cause thermal cracking of kerogen in the identified quantity of oil shale where gas and liquid hydrocarbons are recovered from the identified quantity of oil shale via the gas and liquid recovery lines.

The present invention may also be characterized as a process for recovering hydrocarbons from oil shale where the process comprises a first step of identifying a quantity of oil shale in the ground. A portion of the oil shale is removed to create void space the upper portion of the quantity of oil shale in the ground where the remaining oil shale in the ground is rubblized by detonating explosives to enable gases to flow through the identified quantity of oil shale. A gas delivery line is installed to provide gas into the remaining void space at the upper portion of the identified quantity of oil shale in the ground and gas and liquid recovery lines are installed near the lower portion of the identified quantity of oil shale. A substantially oxygen-free gas is injected through the gas delivery line that is heated to a temperature that will increase the temperature of the identified quantity of oil shale and cause thermal cracking of kerogen in the identified quantity of oil shale. Gas and liquid hydrocarbons are recovered from the identified quantity of oil shale via the gas and liquid recovery lines altering the oil shale to form spent shale. After the hydrocarbons are essentially recovered from the spent shale, burning char in the spent shale by injecting a combination of air and oxygen depleted gases into the spent shale to control the burn rate of the char. The temperature of the identified volume of oil shale and the temperature of the gases returning from the identified volume of oil shale through the gas line are monitored and the amount of air being added to the recycled gases is adjusted to maintain the temperature of the spent shale to be within a predetermined temperature range.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Turning now to the preferred arrangement for the present invention, reference is made to the drawings to enable a more clear understanding of the invention. However, it is to be understood that the inventive features and concept may be manifested in other arrangements and that the scope of the invention is not limited to the embodiments described or illustrated. The scope of the invention is intended only to be limited by the scope of the claims that follow.

Figure 1:
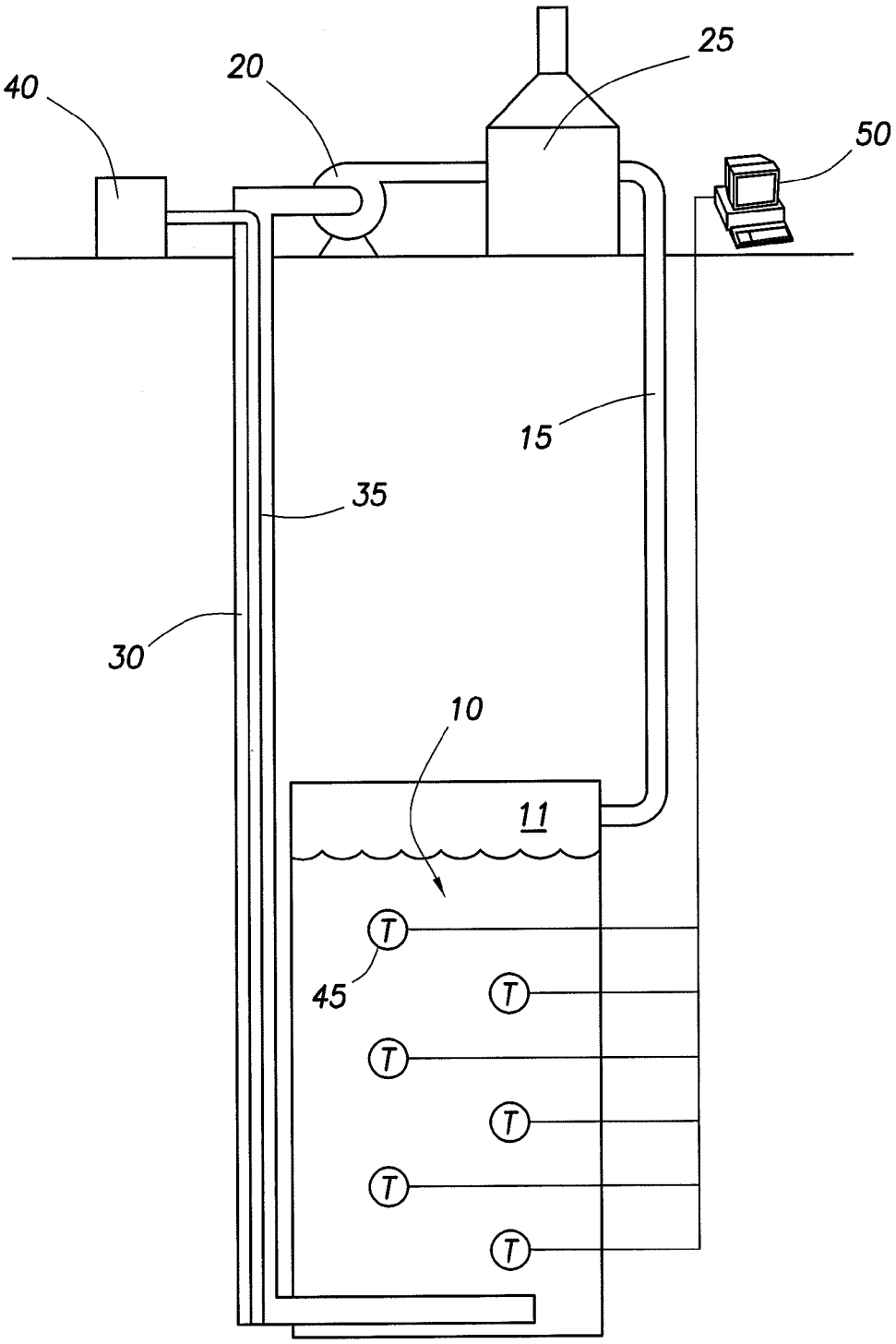
FIG. 1 is a fragmentary cross sectional view of an oil shale retort with diagrammatic components at the surface used for the production of hydrocarbons from oil shale in-situ in an earthen formation.

Turning to FIG. 1, an oil shale retort is generally indicated by the arrow 10. The retort 10 has been formed by removing a portion of the oil shale and then rubbilizing oil shale in a formation within a defined volume. The defined volume forms an underground retort or an in-situ retort and the rubbilizing is accomplished by drilling a pattern of holes into the formation and subjecting the formation to explosions which break up the formation. Preferably about 20% of the shale has been removed at various elevations within the retort to provide void space for the rubblized oil shale to expand into and to provide some remaining void space 11 below the overburden of earth extending to the surface. A gas delivery line 15 carries gases that are substantially free of oxygen from the surface to the void space 11. A blower 20 and process heater 25 work in conjunction to provide hot gases into gas delivery line 15 to begin heating the oil shale at the top of the retort 10. A gas recovery line 30 is similarly arranged to recover gases from the bottom of the retort 10 and carry the gases back to the blower 20. Within or adjacent to the gas recovery line 30 is a liquids recovery line 35 to carry liquids that have separated from the gases at the base of gas recovery line 30. A pump that is not shown or other suitable technology is used for lifting the liquids to a storage tank 40 at the surface. At locations distributed within the retort both horizontally and vertically are temperature sensors 45 which are installed to provide retort temperature readings to a control center 50 at the surface.

Hot gases, preferably gases without sufficient oxygen content to support downhole combustion, are directed into the retort 10 to thermally crack the kerogen in the oil shale. The cracked kerogen forms various hydrocarbon liquids and gases that are driven deeper into the retort by the combination of gravity and the flow of the gases toward the gas recovery line 30. However, it takes a considerable volume of hot gases to heat the oil shale in the vicinity of the void space 11 sufficiently to crack the kerogen. The temperature at which kerogen cracks is between 700° F. and 950° F. The blower 20 directs a substantially oxygen free gas to a process heater 25 which may burn natural gas or propane or the like to provide heat for the gases used in circulation in the retort 10. Later, when kerogen begins cracking and hydrocarbons are recovered in gas recovery line 30, the process heater 25 may be arranged to burn hydrocarbon containing gases that are derived from the oil shale.

As should be recognized, the process for recovering the hydrocarbons from the oil shale begins with a lot of preparation of the retort where an amount of oil shale is removed from the formation to form the void space, the gas inlet and recovery lines are installed along with the liquid recovery line and the temperature sensors. With all this pre-work completed, the recovery of hydrocarbons may begin.

Figure 2:
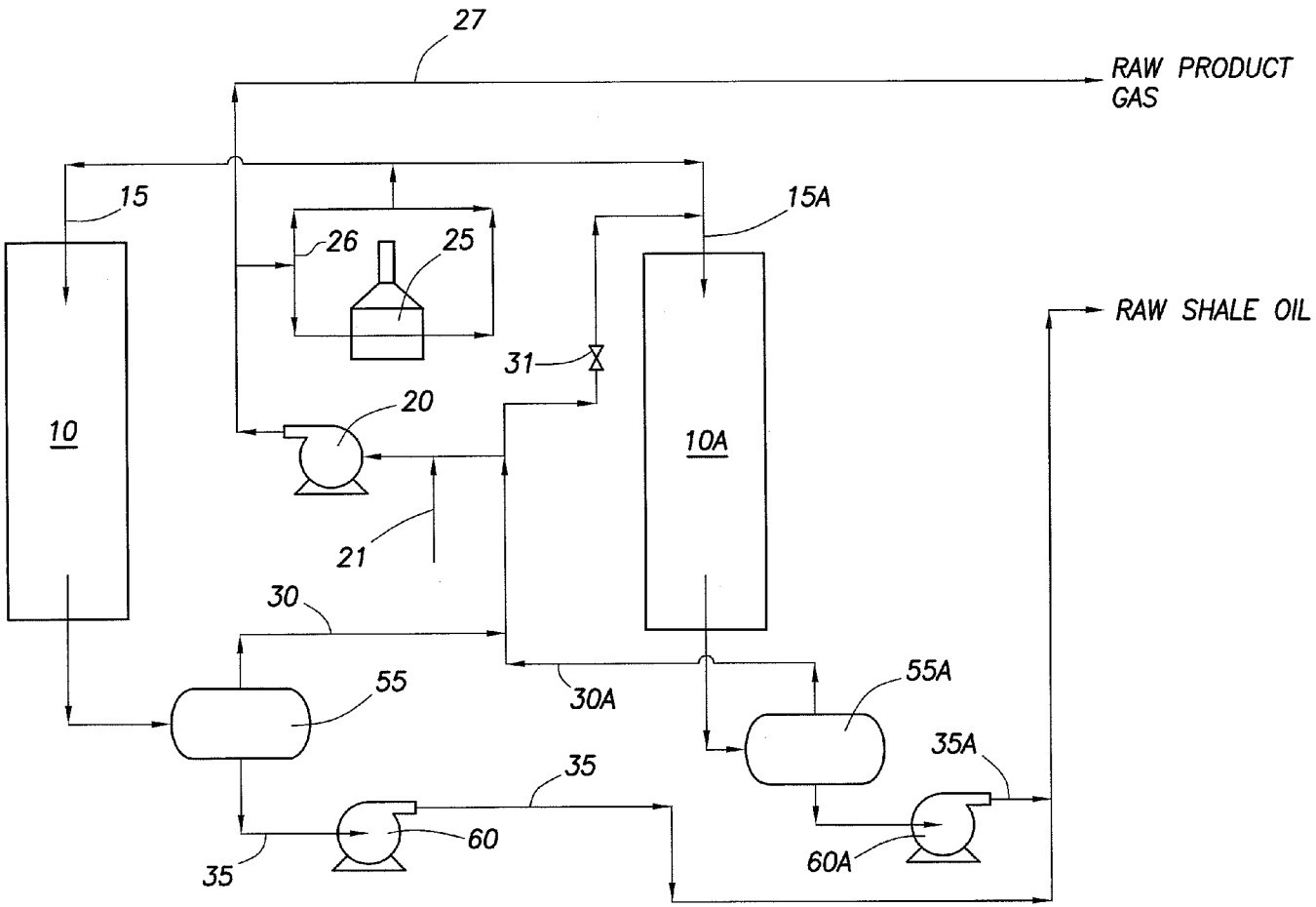
FIG. 2 is a flow diagram of a system for recovering shale oil from an oil shale retort of the present invention.

Turning now to FIG. 2, the installation at the surface may be more easily understood where blower 20 directs the gases to three potential locations. The first is through the process heater 25 and on through gas delivery line 15 and into the retort 10 as has already been described. Once the upper portion of the retort 10 is heated to sufficiently crack the kerogen and sufficient heat has accumulated in the retort, some or all of the gases from the blower 20 are bypassed around process heater 25 via line 26. After raw product gases begin to emerge from the retort some of the gases will be carried via line 27 for further processing. One option for the product gases is for use in process heater 25 to heat the retort 10. While retort 10 is in the hydrocarbon recovery mode, a second retort 10A may be prepared for a similar hydrocarbon recovery process.

Start up of the gas circulation is accomplished initially by natural gas or other suitable gas being delivered via inlet 21 so that oxygen-free or substantially oxygen-free gas enters the retort and all the gas recirculating through the retort will be substantially oxygen-free prior to heating of the retort 10. When heating of the retort begins, the lower portions of the retort will cool the gases such that liquids will condense and separate. A separator 55 is shown in FIG. 2 which will be configured or situated near the bottom of the retort 10 with pump 60 situated to push liquids up through liquid recovery line 35. As the upper portion of the retort 10 heats up, cool gases will be recovered for an extended period of time, including after kerogen is being cracked at upper portions and the hydrocarbons are being recovered at the lower portions of the retort 10. Eventually, heated gases will be recovered in gas recovery line 30. At the time hot gases will begin being recovered, a substantial amount of the gas being provided to the retort from blower 20 will bypass process heater 25 as additional heat will not be necessary to continue to accomplish kerogen cracking. The hot gases then may be used to begin heating second retort 10A. Accordingly, valve 31, which has been closed until this time is opened and allow hot gases from the bottom of retort 10 to enter second retort 10A through second gas delivery line 15A. Second retort 10A will be similar to retort 10 having second gas inlet 15A and gas and liquid recovery lines 30A and 35A, respectively. Eventually, a third, fourth and further retorts will be subjected to the heating and heat recovery process described here.

Hydrocarbon liquids will almost certainly require further treatment and may be transported to a refinery. As noted above, the recovered hydrocarbon gases may be used as fuel at the site for heating a retort, and also for processing of recovered materials. Gased produced at the retort and from subsequent processing of shale oil will include ammonia due to the high nitrogen content of the oil shale. Ammonia has commercial value and may be separated and collected for transport to market.

As the retort heats up and the kerogen cracks and flows to the bottom of the retort, the oil shale retains char that comprises mostly carbon that is solid and adhering to the non-hydrocarbon bearing rock. It is not desirable to recover the char, but rather to use the char as a fuel for producing steam. The oil shale at this point may be described as "spent shale", but there is still energy that may be recovered and used for continued steam generation as required for other plant energy needs.

Figure 3:
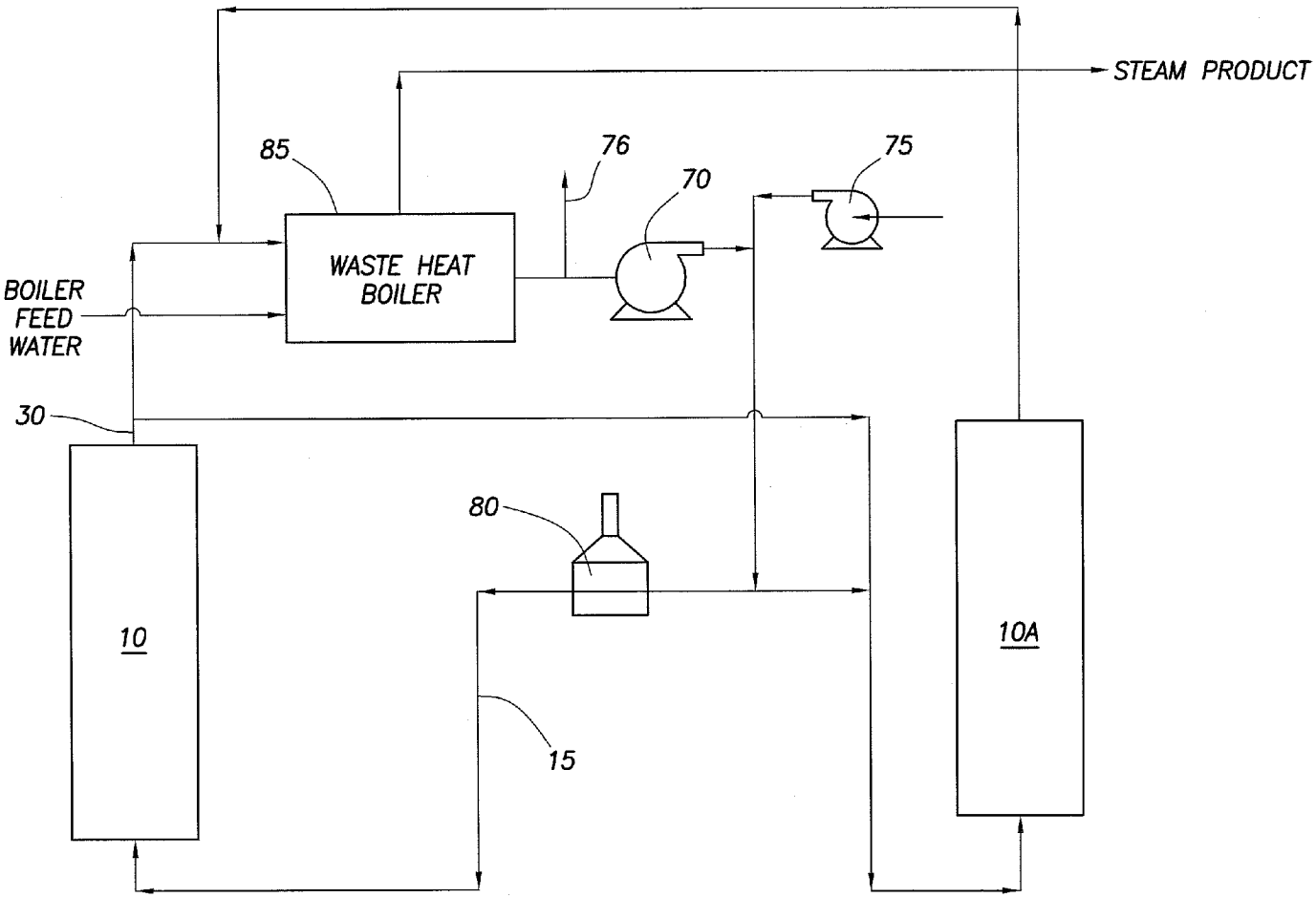
FIG. 3 is a flow diagram of another embodiment of the system for recovering shale oil from an oil shale retort of the present invention.

Turning now to FIG. 3, retort 10 is set up for char burning where blower 70 is arranged to blow gases down through gas delivery line 15. Blower 70 may be the original blower 20 used for hydrocarbon recovery and may be a different blower which is subject to operator selection. It should be understood that char burning is a considerably different step from hydrocarbon recovery. Separating these functions maximizes hydrocarbon recovery and avoids losing hydrocarbons to combustion during char burning.

If retort 10 has cooled substantially since the hydrocarbon recovery process was concluded, the gases being directed into the retort are heated by process heater 80 and a controlled amount of air is added to the inlet gases from air blower 75. With oxygen in the air, the char is heated to its auto-ignition temperature until the char lights off. Process heater 80 is shut down and again the temperature of the retort is closely monitored to maintain the temperature below the temperature that the metal carbonates will decompose. Control system 50, shown in FIG. 1, regulates the amount of air in the inlet gases where excess gases are vented via line 76. Hot gases from the retort 10 are carried back to the surface via gas recovery line 30 and are directed to a waste heat boiler 85 where boiler feed water is heated to produce steam that may be used to make electricity with a steam turbine or other known technology. Electricity is certainly needed by the hydrocarbon recovery system for powering the blowers and other equipment. Steam may also be used as a heat source for various processing systems for recovering hydrocarbons or other valuable products. In a manner similar to the sequential hydrocarbon recovery operations on the retorts, the heat from a char burning retort may be used to light off a next retort rather than having to rely on process heater 80.

The amount of gases vented via line 76 is equalized with the air entering via the air blower 75 so that the total volume of the circulated gases is maintained. Based on the temperature of the retort as measured by the temperature sensors and the temperature of the gases coming out of the retort and the amount of carbon dioxide in the gases being recovered through the recovery line, the air content is adjusted to maintain the retort temperature below temperatures that would cause decomposition of carbonate materials into carbon dioxide. Once the char is ignited, its burn rate is controlled to provide enough heat to continue to burn the char and produce steam in the boiler that may drive steam turbines for electric generation and provide process heat for other processes undertaken at the surface location or nearby areas. While it might take months for the retort to begin producing useful heat at the retort outlet after the char is ignited, it is expected that successive retorts may provide heat and electricity for many, many years. Moreover, the process heat from the first retort will be used to heat or preheat a second and successive retorts. Since the reserves in oil shale amount to thousands of square miles, it is quite conceivable to be able to produce hydrocarbons and heat and electric energy for a century or two centuries and realistically much further into the future than that.

Finally, the scope of protection for this invention is not limited by the description set out above, but is only limited by the claims which follow. That scope of the invention is intended to include all equivalents of the subject matter of the claims. Each and every claim is incorporated into the specification as an embodiment of the present invention. Thus, the claims are part of the description and are a further description and are in addition to the preferred embodiments of the present invention. The discussion of any reference is not an admission that it is prior art to the present invention, especially any reference that may have a publication date after the priority date of this application.

The invention claimed is:

1. A process for recovering hydrocarbons from an underground oil shale formation where the process comprises:

a) identifying a quantity of oil shale in the underground oil shale formation;

b) removing a portion of the oil shale to create void space in the oil shale formation in the ground leaving a remaining oil shale;

c) rubbilizing the remaining oil shale to enable gases to flow through the identified quantity of oil shale;

d) installing a gas delivery line near an upper portion of the identified quantity of oil shale;

e) installing a gas and liquid recovery line near a lower portion of the identified quantity of oil shale;

f) injecting a substantially oxygen-free gas through the gas delivery line that is heated to a temperature that will heat the identified quantity of oil shale and cause thermal cracking of kerogen in the identified quantity of oil shale; and g) recovering gas and liquid hydrocarbons from the identified quantity of oil shale via the gas and liquid recovery line.

2. The process for recovering hydrocarbons from oil shale according to claim 1 wherein the step of identifying a quantity of oil shale comprises identifying a volume of oil shale in the ground.

3. The process for recovering hydrocarbons from oil shale according to claim 2 further comprising the step of burning char that remains after the kerogen has been fully retorted and recovering heat energy created by the burning of the char.

4. The process for recovering hydrocarbons from oil shale according to claim 3 wherein the step of burning the char further comprises injecting air into the identified quantity of oil shale, monitoring the temperature of the identified volume of oil shale and adjusting the rate that amount air being injected to maintain the temperature of the identified volume of oil shale to be within a predetermined temperature range.

5. The process for recovering hydrocarbons from oil shale according to claim 3 wherein the step of burning the char further comprises monitoring the temperature of the gases returning from the identified volume of oil shale through the gas recovery line and adjusting the amount of air being added to maintain the temperature of the gases returning to be within a predetermined temperature range.

6. The process for recovering hydrocarbons from oil shale according to claim 3 wherein the step of burning the char further comprises monitoring the volume of carbon dioxide in the gases returning from the identified volume of oil shale through the gas recovery line and adjusting the amount of air being added to maintain the temperature of the gases returning to be within a predetermined carbon dioxide range.

7. The process for recovering hydrocarbons from oil shale according to claim 3 wherein the step of recovering the heat energy further comprises cooling at least a portion of the gases recovered from the gas recovery line with a waste heat boiler to form steam.

8. The process for recovering hydrocarbons from oil shale according to claim 7 further comprising using the steam to create electricity.

9. The process for recovering hydrocarbons from oil shale according to claim 1 further comprising the step of heating the gases using hydrocarbon gases recovered from the cracking of the kerogen in the identified quantity of oil shale.

10. The process for recovering hydrocarbons from oil shale according to claim 1 further comprising the step of identifying a second quantity of oil shale, rubbilizing the second quantity and installing a gas delivery line at an upper portion of the second quantity, installing gas and liquid recovery lines near the lower portion of the second quantity and directing at least a portion of the hot gases returning from the first quantity into the gas delivery line of the second quantity to begin the process of recovering hydrocarbon gases and liquids from the second quantity, thereby, oil and gas cracked from the kerogen during retorting can always be captured at cool temperatures.

11. The process for recovering hydrocarbons from oil shale according to claim 10 further comprising the step of adding additional heat to the hot gases prior to injecting the hot gases to the second quantity of oil shale.

12. A process for recovering hydrocarbons from oil shale where the process comprises:

a) identifying a quantity of oil shale in the ground;

b) removing a portion of the oil shale to create void space at an upper portion of the quantity of oil shale in the ground, c) rubbilizing the oil shale in the ground by detonating explosives to enable gases to flow through the identified quantity of oil shale;

d) installing a gas delivery line to provide gas into a void space at the upper portion of the identified quantity of oil shale in the ground;

e) installing gas and liquid recovery lines near a lower portion of the identified quantity of oil shale;

f) injecting a substantially oxygen-free gas through the gas delivery line that is heated to a temperature that will heat the identified quantity of oil shale and cause thermal cracking of kerogen in the identified quantity of oil shale;

g) recovering gas and liquid hydrocarbons from the identified quantity of oil shale via the gas and liquid recovery lines altering the oil shale to form spent shale;

h) burning char in the spent shale by injecting a combination of air and oxygen depleted gases into the spent shale to control the burn rate of the char; and i) monitoring the temperature of the identified volume of oil shale and the temperature of the gases returning from the identified volume of oil shale through the gas line and adjusting the amount of air being added to the oxygen depleted gases to maintain the temperature of the spent shale to be within a predetermined temperature range.

* * * * *